US006068396A

United States Patent [19]

Baudin

[11] Patent Number: 6,068,396

[45] Date of Patent: May 30, 2000

[54] DEVICE FOR EXTEMPORANEOUS MIXING OF AT LEAST TWO PRODUCTS

[75] Inventor: Gilles Baudin, Domont, France

[73] Assignee: L'Oreal, Paris, France

[21] Appl. No.: 09/139,734

[22] Filed: Aug. 25, 1998

[30] Foreign Application Priority Data

Sep. 1, 1997 [FR] France ..... 97 10858

[51] Int. Cl.[7] ..... B01F 11/00; B65D 25/08

[52] U.S. Cl. ..... 366/130; 206/219; 215/DIG. 8

[58] Field of Search ..... 366/130, 129, 366/349; 206/219, 220, 221; 215/DIG. 8

[56] References Cited

U.S. PATENT DOCUMENTS

| | | | |
|---|---|---|---|
| 3,321,097 | 5/1967 | Solowey | 206/221 |
| 3,521,745 | 7/1970 | Schwartzman | 215/DIG. 8 |
| 4,823,946 | 4/1989 | Stoeffler et al. | 206/221 |
| 5,186,323 | 2/1993 | Pfleger | 206/221 |
| 5,277,303 | 1/1994 | Goyet et al. | 206/221 |
| 5,417,321 | 5/1995 | Halm | 206/221 |
| 5,447,226 | 9/1995 | Laine | 206/219 |
| 5,647,481 | 7/1997 | Hundertmark et al. | 206/219 |
| 5,908,107 | 6/1999 | Baudin | 206/221 |

FOREIGN PATENT DOCUMENTS

| | | |
|---|---|---|
| 0 298 357 | 1/1989 | European Pat. Off. . |
| 0 315 440 | 5/1989 | European Pat. Off. . |
| 0 528 707 | 2/1993 | European Pat. Off. . |
| 0 694 483 | 1/1996 | European Pat. Off. . |
| 2 239 390 | 2/1975 | France . |
| 3140398 | 9/1982 | Germany . |

*Primary Examiner*—Tony G. Soohoo

*Attorney, Agent, or Firm*—Oblon, Spivak, McClelland, Maier & Neustadt, P.C.

[57] ABSTRACT

A device (1) for the extemporaneous mixing of at least two products includes a pot (27) intended to receive a pulverulent or high viscosity product, and having a free edge (31) which delimits an opening (30) with a cross-section similar to that of the pot (27); an upper container (2) intended to contain a liquid product; an intermediate element (14) having a first end (22) which defines an opening with a cross-section similar to the opening (30) of the pot, and a second end (15) which is intended to be mounted on an open end (10) of the upper container (2). A part (21) detachably obturates an opening (20) situated between the upper container (2) and the intermediate element (14), and the intermediate element (14) defines together with the pot (27) a volume at least equal to the volume of the mixture. Further elements (36, 37) eject the obturating element (21) and obtain mixing in the space defined by both the pot (27) and the intermediate element (14).

16 Claims, 2 Drawing Sheets

DEVICE FOR EXTEMPORANEOUS MIXING OF AT LEAST TWO PRODUCTS

BACKGROUND OF THE INVENTION

1. Field of the Invention

The present invention relates to a device for the extemporaneous mixing of two products. The invention is especially suitable for the mixing of two products, whereof one is in a pulverulent or high viscosity form (which can range up to that of a cream), such as the products sometimes used in the field of perms or in hair coloring. However, other applications may be envisaged.

2. Description of the Related Art

FR-A-2 680 357 describes a packaging unit capable of making such a mixture and comprising a first bottle for a first product, this bottle being open at its base in the form of a skirt and being provided at its top with a dispensing nozzle. Connecting means are fixed to the base of the first bottle and comprise a central duct receiving a separable obturator in its top portion, allowing the first bottle to be closed. A second bottle contains a second product and is provided with a neck capable of being engaged in the central duct, this neck being fitted with a detachable closing means. The neck carries driving means for cooperating with complementary means provided on the central duct after the closing means have been removed to permit the ejection of the obturator and permit the mixing of the two products.

Although satisfactory for applications wherein the two constituents to be mixed are relatively liquid, such a device has proved to be altogether unsuitable when one of the constituents is in the form of a powder or has a consistency similar to that of a cream. Indeed, such a device has a constricted zone or one of a smaller cross-section in the vicinity of the detachable closing means, which zone is hardly suitable for obtaining good mixing. In practice, when the high viscosity product is disposed in the upper compartment, it can only with difficulty flow by gravity to come to mix with the product contained in the lower container. When the pulverulent or high viscosity product is contained in the lower container, the constricted zone leads to a small exchange surface between the two products. Mixing is thus difficult.

Mixing systems are also known which are more suitable for pulverulent or high viscosity products. In these devices, the product in cream form. For example, a coloring agent may be disposed in a deformable tube (typically made of aluminum) and is ejected by squeezing the sides of the tube. In yet other devices, the high viscosity or pulverulent product is contained in a container whose sides form a bellows mechanism. However, these devices sometimes pose problems in preserving the products, and generally do not have a pleasing appearance.

SUMMARY OF THE INVENTION

Thus, one of the objects of the invention is to provide a device for extemporaneous mixing two products, and to at least partially solve the aforementioned problems.

It is a further object of the invention to provide a device suitable for mixing two products, one of which is in the form of a powder or a high viscosity product.

Yet a further object of the invention is to provide such a device in which bringing the non-liquid product into contact with the liquid product does not require substantial deformation of the container which contains the non-liquid product.

Yet another object of the invention is to provide a device suitable for mixing two products, at least one of which is highly oxidizable in the presence of atmospheric oxygen.

In accordance with the invention, the above and other objects are attained by a device for the extemporaneous mixing of at least two products, including a pot intended to receive a first product, and a free edge whereof delimits an opening with a cross-section similar to that of the pot; an upper container intended to contain a second product, and having a first end surmounted by a dispensing nozzle having an opening for the dispensing of the mixture; an intermediate element having a first end which is intended to be mounted in a leakproof manner on the opening of the pot and defines an opening with a cross-section similar to the opening of the pot, and a second end opposite to the first and intended to be mounted in a leakproof manner on a second end of the upper container opposite to the first. An obturating element detachably obturates an opening situated between the upper container and the intermediate element, the intermediate element defining together with the pot a volume at least equal to the volume of the mixture. Another part ejects the obturating element and leaves the mixture in the space defined by the pot and by the intermediate element.

Thus a mixing zone is obtained which offers a large exchange zone between the two products. The mixing zone is devoid of any "dead" area capable of retaining and isolating a portion of one and/or the other of the constituents before the mixing, which makes it possible to obtain a perfectly homogenized mixture. The whole of the products is mixed, which allows the required proportions to be adhered to and offers a mixture whose properties are optimized and correspond to those advertised.

Advantageously, the first product is non-liquid, e.g., a powder or a high viscosity product such as a cream. In this case, mixing does not require any deformation of the container containing the pulverulent or high viscosity product, which affords wider scope in the choice and thickness of the materials. The manipulation is thus simplified and the preservation of the formula is significantly improved.

Advantageously, the volume defined by the intermediate element is at least equal to the volume of the second product contained in the upper container, the first product occupying substantially the whole volume of the pot before mixing. Thus, in the case where the first product is highly oxidizable in air, the risk of its deterioration is reduced.

Advantageously, the profile of the space defined by the pot and the intermediate element is substantially uniform over its whole height or even varies progressively in one direction or the other (increasing or decreasing). However, the variation is preferably small. A small variation may be understood to mean a variation of a few mm over a height of approximately 10 cm. In other words, the mixing zone defined by the pot and the intermediate element does not have any substantial constricted zone or other sudden variation of the profile which could affect the obtaining of a good mixture.

According to one embodiment, the obturating means comprises a stopper carried by an axial skirt situated in the vicinity of the second end of the intermediate element, and one free edge of which delimits the opening. The stopper may be mounted on the axial skirt by catch engagement.

The means for ejecting the obturating element may comprise a stem carried by a surface of the stopper situated inside the intermediate element, the stem being capable, during the mounting of the pot on the intermediate element, of coming into engagement with a projecting element disposed axially in the bottom of the pot and of provoking the ejection of the stopper. Preferably, the stem is centered on the axis of the device. However, other known arrangements are possible.

According to a preferred embodiment, the stem is slightly shorter in length than the axial height of the intermediate element, so that before being mounted on the pot the intermediate element can rest on a flat surface without ejecting the obturating element.

Advantageously, the first end of the intermediate element is threaded in a leakproof manner on the opening of the pot. For this purpose, a collar is formed in the vicinity of the opening of the pot and has a thread on an external surface, intended to cooperate with a corresponding thread provided on an internal surface of the intermediate element in the vicinity of the first end. An internal skirt of the collar has an external diameter slightly smaller than the internal diameter of the collar being carried by the first end of the intermediate element so as to ensure a leakproof mounting of the pot on the intermediate element.

Similarly, in a preferred embodiment, the second end of the intermediate element is threaded in a leakproof manner on the second end of the upper container. For this purpose too, a collar is formed in the vicinity of the second end of the upper container, the collar having a thread on an external surface and intended to cooperate with a corresponding thread provided on an internal surface of the intermediate element in the vicinity of the second end. An internal skirt of the collar has an external diameter slightly smaller than the internal diameter of the collar being carried by the second end of the intermediate element so as to ensure a leakproof mounting of the upper container on the intermediate element.

Before being mounted on the intermediate element, the pot is obturated by a screw-on stopper. Alternatively, provision could be made for a heat-sealed covering or one bonded by any other appropriate means.

The dispensing nozzle may be screwed onto the first end of the upper container. The opening is obturated by a frangible tab to be broken before the mixture is dispensed. According to a variant, the opening is obturated by a screw-on stopper.

The mixture may be a product for application to the hair. The second product may be an oxidant product in liquid form, the first product being a colorant in the form of a powder or a high viscosity product.

BRIEF DESCRIPTION OF THE DRAWINGS

Apart from the arrangements set out above, the invention includes a number of other features which will be explained below with regard to non-restrictive examples of the embodiment, described with reference to the attached drawings, wherein.

DETAILED DESCRIPTION OF THE PREFERRED EMBODIMENT

Figure 1A:
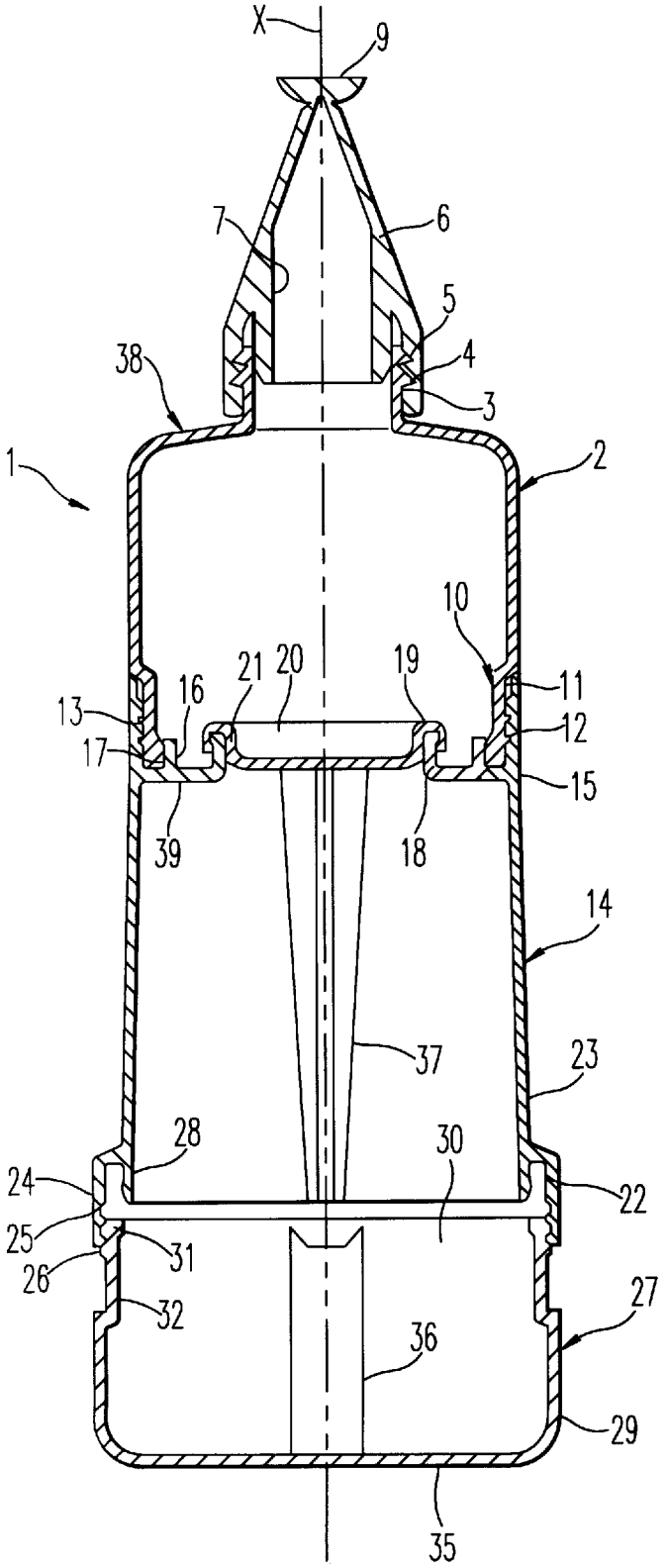
FIG. 1*a* shows an embodiment of the device during the mounting of the container containing a pulverulent or high viscosity product on the rest of the device.

The mixing device illustrated in FIG. 1*a* has a longitudinal axis X and comprises an upper container 2 (intended to contain the oxidant). A first end 38 of the container 2 is surmounted by a neck 3 whose external surface has a thread 4 capable of cooperating with a corresponding thread 5 carried by a dispensing nozzle 6. The seal of the mounting of the dispensing nozzle on the container 2 is reinforced by a skirt 7 carried by the nozzle. The dispensing nozzle 6 has an outlet opening 8 which, before the first use, is obturated by a frangible tab 9. For example, the dispensing nozzle is made of polypropylene and the upper container 2 is made of polypropylene.

The bottom end 10 of the container 2 is open and forms a collar 11 with a wide opening and an external thread 12 capable of cooperating with a corresponding thread 13 provided on the internal surface of an intermediate element 14 in the vicinity of its upper end 15.

In the vicinity of the upper end 15, the intermediate element 14 also has a transverse annular partition 39 carrying a sealing skirt 16 concentric with the side wall of the intermediate element 14 and with a diameter smaller than the diameter of the side wall so as to define, together with the side wall of the intermediate element 14, a U-shaped annular groove in the vicinity of the second end 15 for receiving the free edge of the collar 11 with a force-fit. For this purpose, the external diameter of the sealing skirt 16 is slightly smaller than the internal diameter of the collar 11 of the container 2. A catch engagement ring 17 may be provided to ensure that the assembly comprising the upper container 2 and the intermediate element 14 cannot be dismantled and to reinforce the seal of the mounting. Another skirt 18 with a diameter smaller than the diameter of the sealing skirt 16 is also formed in the vicinity of the upper end of the intermediate element 14. This skirt 18 is carried by the annular transverse partition 39 and has a free edge 19 defining an opening 20 detachably obturated by a retractable stopper 21. In the embodiment illustrated, the stopper 21 is mounted by catch engagement on the axial skirt 18. Thus, in this configuration, the upper container 2 is separated for the intermediate element 14. By way of example, the obturator 21 may be made of polyethylene or polypropylene.

The intermediate element has a substantially cylindrical body 23 with an axial height greater than the axial height of the container 2. The bottom end 22 of the intermediate element 14 opposite to the end 15 is also open. It has a skirt 24 slightly offset towards the outside as compared with the body 23, and whose internal surface has a thread 25 capable of cooperating with a thread 26 carried by the external surface of the upper end of the container 27. A sealing skirt 28 is disposed in alignment with the body 23, which defines together with the skirt 24, a U-shaped groove capable of receiving the free edge 31 of the container 27. A catch engagement bead may also be provided to ensure that after the container 27 has been screwed onto the intermediate element 14, the unit thus obtained cannot be taken apart. The thread 26 of the container 27 is carried by an end 32 forming a collar very slightly offset towards the inside as compared with the body 29 of the container. However, in the manner of a pot, the opening 30 delimited by the free end 31 of the container 27 has a cross-section substantially equal to the cross-section of the pot 27. Similarly, the opening of the pot 30 has a cross-section substantially equal to the cross-section of the opening delimited by the free edge of the sealing skirt 28. Thus, when the pot is mounted on the bottom end of the intermediate element 14, the internal diameter of the unit is substantially uniform from the bottom of the pot up to the transverse partition 39. In the embodiment illustrated, it progressively decreases very slightly. The intermediate element 14 may be made of polypropylene (PP).

At its bottom 35, the pot 27 has an element forming a projection 36 and, as will be seen in greater detail below, capable of coming into engagement with the free end of a stem 37 carried by the bottom surface of the stopper 21, which engagement causes the stopper to be ejected and the mixing to occur. The stem 37 has an axial height slightly smaller than the axial height of the intermediate element 14, so that the assembly comprising the upper container 2 and the intermediate element 14 can be placed upright on a flat surface without the risk of accidental ejection of the stopper 21. The presence of the projecting element 36 in the bottom of the pot makes it possible to limit the axial height of the intermediate element 14. The element 36 may be molded together with the container 27. The element 37 may be molded together with the obturator 21.

By way of illustration, the pot 27 is obtained by molding plastic materials chosen from polyvinyl chlorides or a complex of materials of the polyethylene terephthalate (PET)/polyethylene (PE) type, or polyethylene (PE)/ethylene vinyl alcohol (EVOH)/polyethylene (PE). In the case of a device used for hair coloring, the container 27 contains the colorant in the form of a cream or powder. In contrast to the conventional devices, the mixture is obtained without having to compress the sides of the container which contains the cream or the powder. The cream (or powder) may therefore be contained in a semi-rigid or rigid structure, which permits better preservation.

Figure 2:
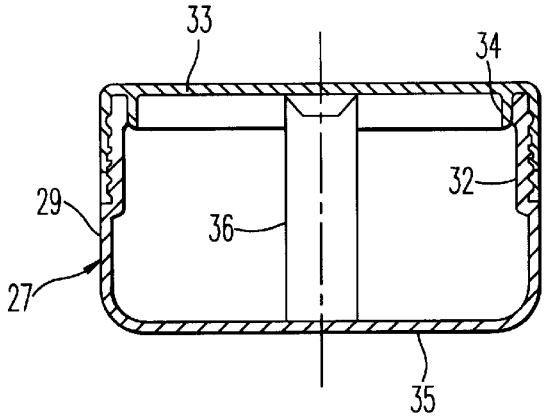
FIG. 2 shows the container containing the pulverulent or high viscosity product before being mounted on the device.

As illustrated in FIG. 2, the pot 27 is obturated in a leakproof manner during its carriage or storage by a lid 33 which is screwed on and has a sealing skirt 34 similar to the sealing skirts 28 or 16 discussed above. The lid 33 may be made of polypropylene.

Figure 1B:
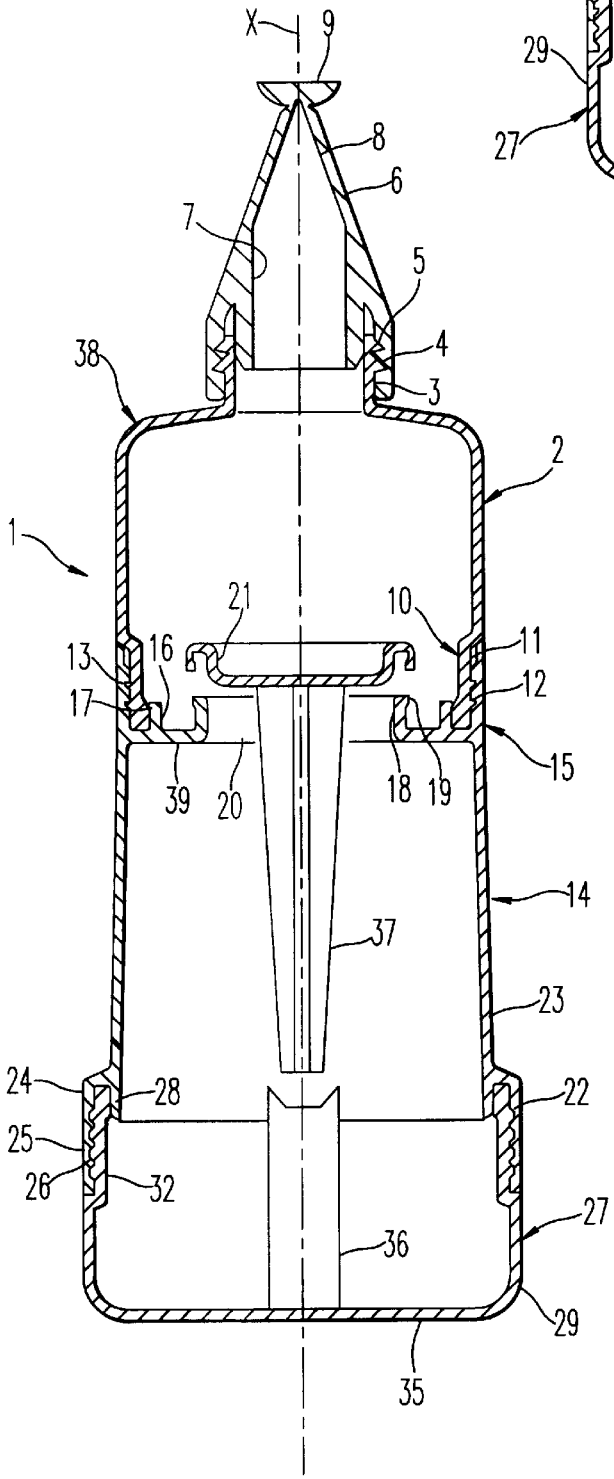
FIG. 1*b* shows an embodiment of the device during the mounting of the container containing a pulverulent or high viscosity product during the making of the mixture.

To use the device in accordance with the invention, the user removes the lid 33 from the container 27 and presents its opening 30 to face the bottom end 22 of the intermediate element 14 (FIG. 1*a*), and then screws the pot 27 onto the intermediate element. During the screwing, the projecting element 36 comes to abut against the free end of the stem 37 and subsequently ejections the stopper 21 (FIG. 1*b*). The liquid (the oxidant in the case in point) contained in the upper container 2 drops by gravity into the space delimited by the body 23 of the intermediate element 14 over a large exchange surface with the cream or powder contained in the pot 27. The intermediate element 14 is sufficiently high for all the liquid contained in the container 2 to flow beneath the portion of the annular transverse partition 39 carrying the skirts 16 and 18. In other words, the space delimited by the pot 27 and the intermediate element 14 is greater than, or equal to the volume of the mixture. For this purpose, in the case where the cream or powder occupies substantially the whole of the space defined by the pot 27, the space delimited by the intermediate element 14 is at least equal to the volume of liquid contained in the upper container 2.

After the stopper 21 has been ejected, it only remains to shake the unit so as to homogenize the mixture. The mixture can then be applied by means of the dispensing nozzle 6 after the frangible tab 9 has been broken. The emergence of the product is promoted by pressing on the sides of the container 2.

Although particularly advantageous for application using a non-liquid product, in particular a pulverulent or high viscosity product, the device does not thereby become less advantageous for liquid products because of its advantageous mixing zone, which makes it possible to optimize mixing irrespective of the nature and consistency of the mixed products.

In the preceding detailed description, reference has been made to preferred embodiments of the invention. It is obvious that variants may be introduced therein without departing from the spirit of the invention such as claimed below. By way of example, although in the illustrated embodiment, the ejection of the stopper 21 is produced by axial pressure via the axial stem 37 and the projecting element 36, it is obvious that this ejection can be promoted by offsetting the stem 36 and the element 37. Similarly, provision may be made for the pot 27 obturated by its lid 33 to be wedged in its storage or transport position in the bottom end 22 of the intermediate element 14. For this purpose, to prevent the ejection of the stopper 21, an axial cutout is arranged in the lid 33 so as to receive the free end of the stem, without the bottom of the cutout being capable of coming into engagement with the free end of the stem.

What is claimed is:

1. A device for the extemporaneous mixing of at least two products, comprising:

a pot receiving a first product, said pot having a free edge which delimits an opening with a cross-section similar to that of the pot;

an upper container for a second product and having a first end surmounted by a dispensing nozzle having an opening for the dispensing of the mixture;

an intermediate element having a first end mountable in a leakproof manner on the opening of the pot with a cross-section similar to the opening of the pot, a second end mountable in a leakproof manner on a second end of the upper container;

an obturatable opening in said intermediate element and closed by an obturating element detachably obturating the obturatable opening, said intermediate element defining together with the pot a volume at least equal to a volume of a the upper container and the pot; and means for provoking ejection of the obturating element.

2. A device according to claim 1, wherein the first product is a non-liquid product and the second product is a liquid product.

3. A device according to claim 1, wherein a volume defined by the intermediate element is at least equal to a volume of the second product, the first product occupying substantially the whole volume of the pot before the mixing.

4. A device according to claim 1, wherein the obturatable opening is formed in a transverse partition adjacent said first end of said intermediate element and having an axial skirt, and wherein the obturating element comprises a stopper.

5. A device according to claim 4, wherein the stopper is mounted on the axial skirt by catch engagement.

6. A device according to claim 4, wherein the means for provoking ejection of the obturating element comprise a projecting element disposed axially in the bottom of the pot and an axial stem carried by the stopper, said stem coming into engagement with the projecting element during the mounting of the pot on the intermediate element.

7. A device according to claim 6, wherein said stem is shorter in length than an axial height of the intermediate element.

8. A device according to claim 1, wherein the first end of the intermediate element is threadably mounted in a leakproof manner on the opening of the pot.

9. A device according to claim 8, including a collar in the vicinity of the opening of the pot, said collar having an external thread cooperable with an internal thread of the intermediate element in the vicinity of the first end thereof, said first end further having an internal skirt with an external diameter smaller than an internal diameter of the collar carried by the first end of the intermediate element.

10. A device according to claim 1, wherein the second end of the intermediate element is threadably mounted in a leakproof manner on the second end of the upper container.

11. A device according to claim 10, further comprising another collar in the vicinity of the second end of the upper container, said another collar having an external thread cooperable with an internal thread of the intermediate element in the vicinity of the second end thereof, further comprising an internal skirt with an external diameter smaller than the internal diameter of the another collar and carried by said annular transverse partition of the intermediate element.

12. A device according to claim 1, further comprising a screwed-on lid for obturating the opening of the pot.

13. A device according to claim 1, wherein the dispensing nozzle is screwed onto the first end of the upper container, an opening of the dispensing nozzle being obturated by a frangible tab.

14. A device according to claim 1, wherein the mixture is a product for application to hair.

15. A device according to claim 1, wherein the second product is an oxidant product in liquid form, the first product being a colorant.

16. A device for the extemporaneous mixing of at least two products, comprising:

a pot receiving a first product, said pot having a free edge which delimits an opening with a cross-section similar to that of the pot;

an upper container for a second product and having a first end surmounted by a dispensing nozzle having an opening for the dispensing of the mixture;

an intermediate element having a first end mountable in a leakproof manner on the opening of the pot, said intermediate element, when mounted on the pot, being in fluid communication with said pot through an opening of the intermediate member with a cross-section similar to the opening of the pot, a second end mountable in a leakproof manner on a second end of the upper container;

an obturatable opening in said intermediate element and closed by an obturating element detachably obturating the obturatable opening, said intermediate element defining together with the pot a volume at least equal to a volume of a mixture of the first and second products; and means for provoking ejection of the obturating element.

* * * * *